US005566416A

United States Patent [19]

Karls

[11] Patent Number: 5,566,416

[45] Date of Patent: Oct. 22, 1996

[54] TWO-IN-ONE BRUSH

[75] Inventor: Jamie L. Karls, Milwaukee, Wis.

[73] Assignee: Schaefer Brush Manufacturing Company, Inc., Waukesha, Wis.

[21] Appl. No.: 521,209

[22] Filed: Aug. 30, 1995

[51] Int. Cl.[6] ..... B08B 9/00; A46B 5/02

[52] U.S. Cl. ..... 15/104.04; 15/104.05; 15/106; 15/104.2; 15/160

[58] Field of Search ..... 15/104.2, 106, 15/104.04, 104.05, 160, 114, 118

[56] References Cited

U.S. PATENT DOCUMENTS

| | | | |
|---|---|---|---|
| 1,710,127 | 4/1929 | Vaughn . | |
| 1,950,862 | 3/1934 | Page | 15/106 |
| 3,088,150 | 5/1963 | Sweeney . | |
| 3,188,674 | 6/1965 | Hobbs | 15/104.04 |
| 3,266,075 | 8/1966 | Conrad . | |
| 4,014,063 | 3/1977 | Bunke . | |
| 4,038,715 | 8/1977 | Litt . | |
| 4,050,825 | 9/1977 | Stein | 15/106 |
| 4,133,070 | 1/1979 | Litt | 15/106 |
| 4,238,867 | 12/1980 | Ruggero | 15/104.04 |
| 4,301,567 | 11/1981 | Tucker | 15/104.04 |
| 4,575,892 | 3/1986 | Ross . | |
| 4,819,291 | 4/1989 | Gunjian . | |
| 4,862,549 | 9/1989 | Criswell et al. . | |
| 4,899,409 | 2/1990 | Cox, Jr. . | |
| 5,058,327 | 10/1991 | Buchanan . | |
| 5,269,104 | 12/1993 | Di Biagio | 15/104.04 |

FOREIGN PATENT DOCUMENTS

| | | | |
|---|---|---|---|
| 946560 | 5/1974 | Canada | 15/106 |
| 1031561 | 6/1966 | United Kingdom | 15/104.04 |

*Primary Examiner*—David Scherbel
*Assistant Examiner*—Randall E. Chin
*Attorney, Agent, or Firm*—Andrus, Sceales, Starke & Sawall

[57] ABSTRACT

A two-in-one brush for an item to be cleaned comprises a hollow, generally cylindrical, one-piece handle having a pair of open end portions, a grippable external surface and a transverse web disposed perpendicular to the handle between the open end portions. An annular female brush member is fixed within one open end portion of the handle and a male brush member is anchored within the other open end portion. The brush members have outermost ends terminating within the open end portions and being continuously accessible therefrom wherein the handle substantially shields the brush members from inadvertent manual contact therewith yet permits contact of the brush members with the item to be cleaned.

17 Claims, 2 Drawing Sheets

10
12
16
20

12
24
42
28
44
32
34
62
18
64
22
14
46
52
48
50
16
54
20
58
20
58
16
54
56

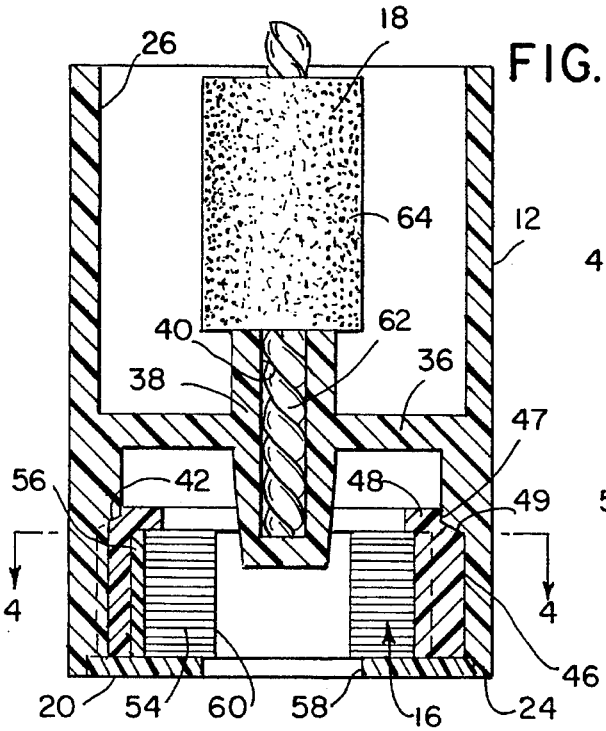
FIG. 3
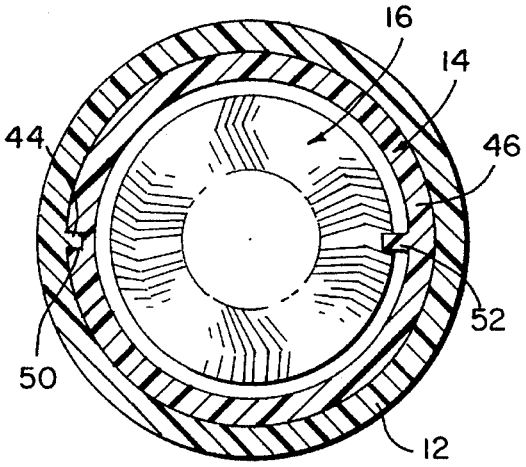
FIG. 4
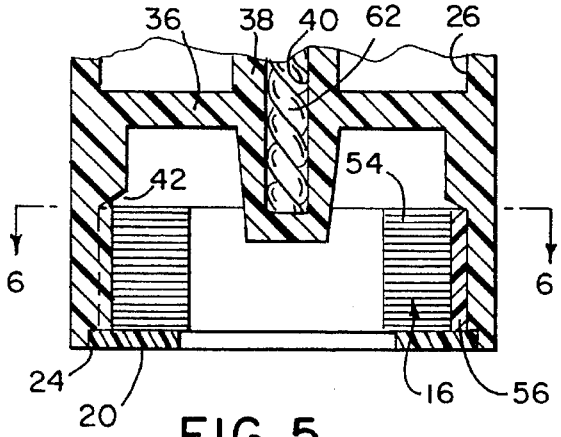
FIG. 5
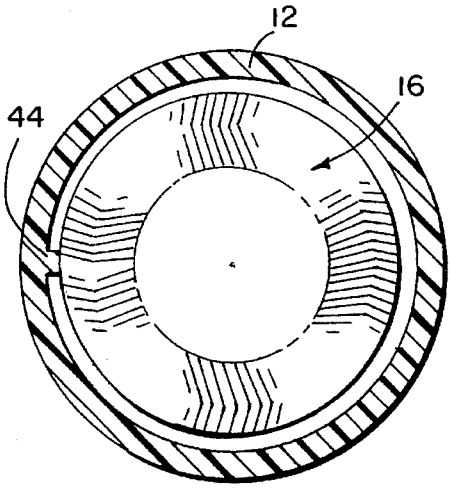
FIG. 6
FIG. 7
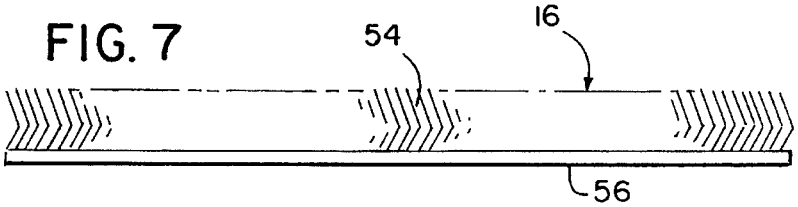
FIG. 8
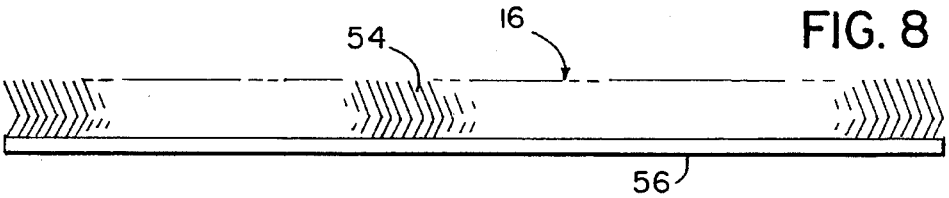

TWO-IN-ONE BRUSH

FIELD OF THE INVENTION

This invention relates generally to tools for cleaning tubing and fittings having circular cross-sections differing in diameter, and more particularly pertains to brush arrangements for cleaning the outer and inner end surfaces of pipes, fittings, connectors, and the like.

BACKGROUND OF THE INVENTION

Soldering or brazing of pipe or tubing requires that the mating surfaces of the pipe and fittings be thoroughly cleaned to prevent oxide-free and contaminant free surfaces which can be melted by the molten solder or brazing alloy. This is required to form sound joints which are free of porosity and voids and which will not leak.

Various devices comprising male and female brush members have long been available for performing the operations of scraping for cleaning, scarifying, deburring and abrading to remove grit and foreign matter such as drops of solder, chemical substances or other debris on the outer and inner surfaces of the tubing or piping. Such devices are also employed to clean the surfaces of connectors. Many of these devices feature male cleaning brushes having sharp, aggressive steel wire bristles which are unprotected or exposed by removal of a cover of the like. Examples of such designs are disclosed in U.S. Pat. Nos. 3,088,150, 4,575,892, 4,862,549 and 5,058,327. Other devices offer housing or handle designs which are imperfectly designed to provide the proper shape and grip required for effective rotational and axial movement of the cleaning tool. Still other devices fail to provide the capability of a universally sized handle which will accommodate various brush sizes.

Such predecessor cleaning tools have not proved to be entirely effective, safe and convenient to use and it remains desirable to provide an improved tool or combination brush which will properly and expeditiously clean the inside and outside surfaces of pipes, tubing, and connectors. It is further desirable to provide a combination brush having a one-piece handle having an external gripping surface conducive to improved cleaning and an internal surface designed to prevent inadvertent contact with the male and female brushes.

SUMMARY OF THE INVENTION

The inventive device for cleaning the outside of piping or tubing and the inside of a corresponding fitting advantageously provides a relatively simple, durable combination brush having a handle with a permanently enclosed male brush inside one end and a female brush inside the other end. The design protects the user from the brushes when the device is used and accommodates various sizes of male or female brushes without the use of any covers or secondary parts.

None of the other patented designs for performing similar operations permanently shields the male brush part from the user and/or allows them to hold the tool in this area. Being able to grasp this design over the area where the male brush is fixed allows the user to utilize both brushes in an easier, safer, and more comfortable position.

These and other aspects of the invention are realized in a two-in-one brush for an item to be cleaned comprising a hollow, generally cylindrical, one-piece handle, having a length, a diameter, a longitudinal axis and a pair of open end portions. The handle includes a grippable external surface and includes a transverse web which is disposed substantially perpendicular to the longitudinal axis between the open end portions. An annular female member is fixed on one side of the transverse web within one of the open end portions of the handle and lies in concentric relationship therewith. A male brush member is secured to and extends outwardly from the transverse web and is disposed oppositely along the longitudinal axis from the female brush member and the other of the open end portions of the handle. The female brush member and the male brush member each have outermost ends which terminate within the open end portions and which are continuously accessible therefrom wherein the handle substantially shields the female brush member and the male brush member from inadvertent manual contact therewith, yet permits contact of the male brush member and the female brush member with the item to be cleaned.

In yet another aspect of the invention a combination brush comprises a hollow, generally cylindrical, one-piece housing having a longitudinal axis and a pair of open end portions. The housing has a grippable external surface, an internal surface, and a transverse web disposed substantially perpendicular to the longitudinal axis between the open end portions. A male brush member is secured and permanently enclosed protecting the user from the sharp bristles and allowing them to grasp the area and use the tool without injury and extends outwardly from the transverse web in one of the open end portions of the housing. The female brush holder is disposed in the other of the open end portions. A female brush member is engageable with either the internal surface of the housing or the female brush holder in the other of the open end portions. With this construction, a singularly sized housing is capable of carrying variously sized female brush members.

BRIEF DESCRIPTION OF THE DRAWINGS

FIG. 3 is a cross-sectional view of the two-in-one brush;

FIG. 4 is a cross-sectional view taken on line 4—4 of FIG. 3;

FIG. 5 is a cross-sectional view like FIG. 4 without the brush holder;

FIG. 6 is a cross-sectional view taken on line 6—6 of FIG. 5;

FIG. 7 is an elevational view of one size of female brush; and

FIG. 8 is an elevational view of a female brush larger than shown in FIG. 7.

DETAILED DESCRIPTION OF THE PREFERRED EMBODIMENT

Figures 1, 2:
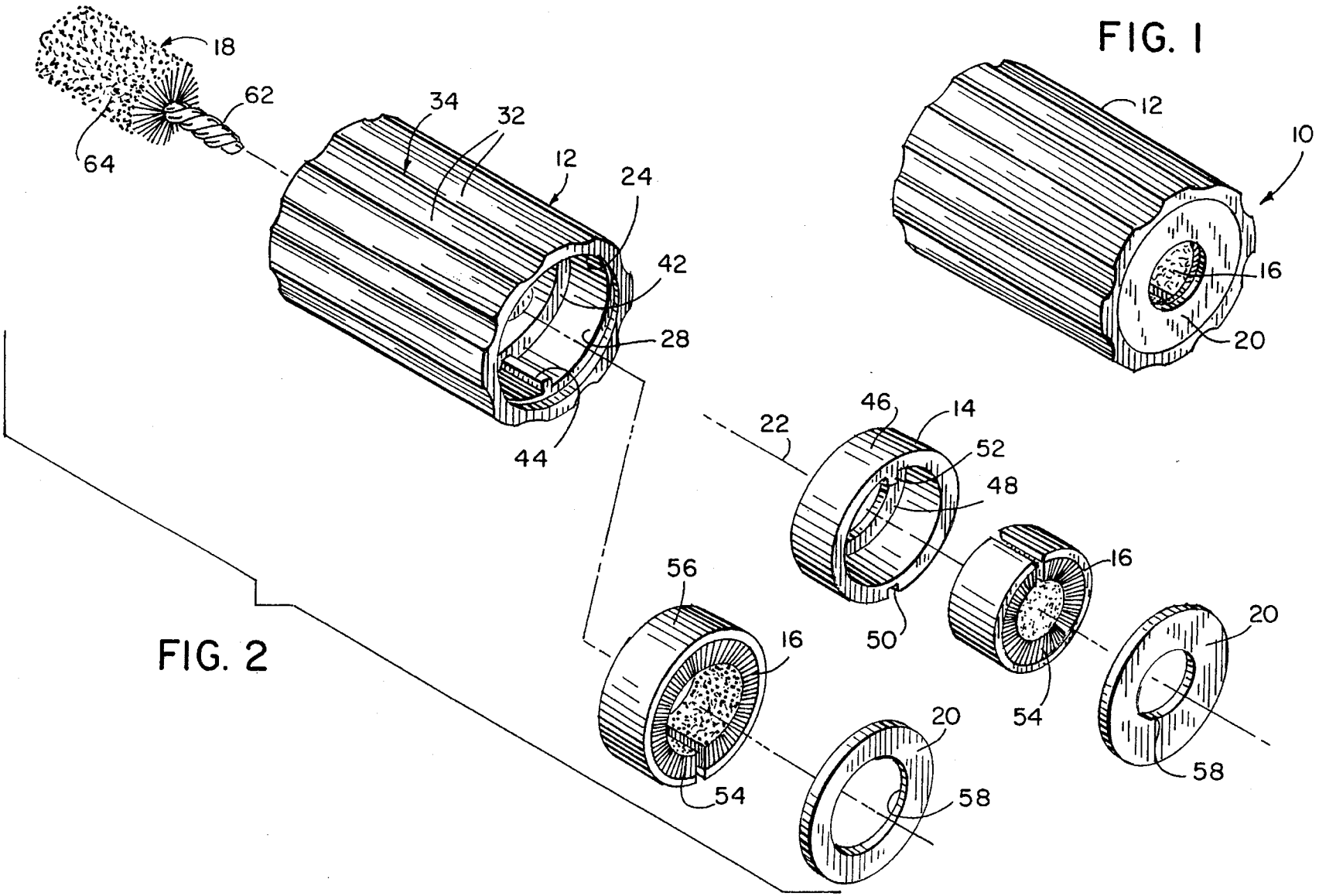
FIG. 1 is an isometric view of the two-in-one brush embodying the invention.
FIG. 2 is an exploded view of two versions of the two-in-one brush shown in FIG. 1.

Referring now to FIGS. 1–8, the two-in-one or combination brush embodying the invention is generally identified by the reference numeral 10. Brush 10 comprises a housing 12, a female brush holder 14, a female brush 16, a male brush 18 and an end cap 20.

Housing 12 is a hollow, generally cylindrical, one-piece member having a longitudinal axis 22 and a pair of opposed, open end portions 24, 26. The interior of housing 12 has a substantially smooth cylindrical, internal surface 28, and the exterior is provided with an undulating pattern formed by a series of circumferentially spaced lands 32 which define a manually grippable external surface 34. A transverse web 36 is disposed within housing 12 substantially perpendicular to the longitudinal axis 22 between open end portions 24, 26 and preferably nearer open end portion 24. Web 36 includes a generally cylindrical boss 38 having a hole 40 formed therein used for mounting male brush 18, as will be described hereafter. Open end portion 24 is provided with an annular shoulder 42 and a rib 44 for mounting female brush 16 alone or female brush holder 14 and female brush 16 together as will also be described hereafter.

As best seen in FIG. 3, female brush holder 14 is a ring-like, externally stepped member including a collar 46 having a first outer diameter and an inwardly directed flange 48. The outer surface of flange 48 defines a crown 47 having a second outer diameter which is smaller than that of collar 46. Crown 47 is offset inwardly with respect to collar 46 by stepped portion 49. The outer surface of collar 46 is provided with a guide groove 50 engageable with rib 44 on the internal surface 28 of housing 12. The inner surface of collar 46 is formed with an inwardly projecting stop member 52 extending through the height thereof and located diametrically opposite guide groove 50.

Female cleaning brush 16 is comprised of tempered steel wire bristle 54 extending from a flexible plastic or rubber backing 56. Brush 16 is produced in various strip lengths shown in FIGS. 7 and 8 designed to be configured into an annulus with inwardly directed bristles and of a size which will fit within collar 46 of female brush holder 14. One edge of brush 16 shown in FIG. 7 fits snugly against flange 48 to prevent rearward axial movement of the brush 16 relative to the collar 46 during use. In addition, ends of brush 16 abut against stop member 52 to prevent brush 16 from rotating relative to collar 46. To prevent forward axial movement of brush 16 relative to collar 46, end cap 20 is formed with an opening 58 coaxial or concentric with hole 40 and is secured within open end portion 24 against the other edge of brush 16.

When brush holder 14 with female brush 16 therein is mounted in open end portion 24 of housing 12 as seen in FIGS. 3 and 4, female cleaning brush 16 will define an aperture 60 coaxial or concentric with the hole 40 formed in boss 38. With this structure, a solid member such as a pipe may be cleaned by inserting the member to be cleaned through the opening 58 and into the aperture 60 defined by the female brush 16 and then rotating and/or sliding the brush 16 relative to the member to be cleaned. If it is desired to clean the outside surface of a tubular member such as a pipe, the closed end of boss 38 may serve as a guide or stabilizing surface around or against which the inner diameter walls of pipe may fit.

Male cleaning brush 18 comprises a conventional twisted wire stem 62 with outwardly directed wire bristles 64 retained between the twists of the stem and trimmed to provide a generally cylindrically shape. Stem 62 is designed to be securely anchored within the walls of hole 40 formed in boss 38 and extends outwardly into open end portion 26 from transverse web 36 in a direction opposite female brush 16. The housing 12, as well as brush holder 14 is preferably formed from a plastic material which may be heated such that the walls of hole 40 in boss 38 will accept stem 62. As will be apparent, when it is desired to clean a connector or the like, the male brush 18 will be utilized by inserting the same into the female connector. Advantageously, an annular space between the periphery of male brush 18 and the internal surface 28 of housing 12 permits cleaning of the most common fitting interior surface.

As a salient feature of the invention, it should be appreciated that female brush holder 14 may not be required if a larger size of female brush 16 is desired. In such a case as depicted in FIGS. 5 and 6, female brush 16 (FIG. 8) is formed into an annulus which will fit directly into the internal surface 28 of housing 12. Thus, one edge of female brush 16 fits snugly against annular shoulder 42 to prevent rearward axial movement of female brush 16 relative to housing 12. In addition, the ends of female brush 16 abut against rib 44 to prevent rotation of brush 16 relative to housing 12. To prevent forward axial movement of brush 16 relative to housing 12, an end cap 20 provided with an opening 58 commensurate with the hole formed by the annular brush 16 and coaxial with hole 40 in boss 38 is secured within open end portion 24 against the other edge of brush 16.

By virtue of this construction, it should be appreciated that housing 12 defines a universally sized handle which accommodates various sizes of male and female brushes 16, 18. The shape of housing 12 and formation of gripping surface 34 provide a perfect handle to perform the twisting motion necessary to clean the inside or outside of a tubular surface. Because the outermost ends of both brushes 16, 18 terminate within the end boundaries of open end portions 24, 26, housing 12 becomes a protective shield. This feature is especially desirable to prevent one's hands from inadvertent manual contact with the sharp, aggressive wire bristles 64 of male brush 18, yet it stills permits contact of the male and female brushes with the item to be cleaned. It should also be appreciated that although both brushes 16, 18 work independently of each other, they are both held in one unit without loose covers or the like to interfere with the cleaning operation.

While the invention has been described with reference to a preferred embodiment, those skilled in the art will appreciate that certain substitutions, alterations and omissions may be made without departing from the spirit thereof. Accordingly, the foregoing description is meant to be exemplary only, and should not be deemed limitative on the scope of the invention set forth with following claims.

I claim:

1. A two-in-one brush for an item to be cleaned comprising;

a hollow, generally cylindrical, one-piece handle having a length, a constant outer diameter, a longitudinal axis and a pair of open end portions, said handle including a grippable, undulating external surface along the entire length thereof and including an internal transverse web disposed substantially perpendicular to said longitudinal axis between said open end portions;

an annular female brush member disposed on one side of said transverse web and fixed within one of said open end portions of said handle and in concentric relationship therewith, and;

a male brush member secured to and extending outwardly from said transverse web and disposed oppositely along said longitudinal axis from said female brush member in the other of said open end portions of said handle;

said female brush member and said male brush member each having outermost ends terminating within said open end portions and being continuously accessible therefrom wherein said handle substantially permanently shields said female brush member and said male brush member from inadvertent manual contact therewith yet permits contact of said male brush member and said female brush member with the item to be cleaned.

2. The brush of claim 1, wherein said external grippable surface comprises a series of circumferentially spaced lands extending along the length of said handle.

3. The brush of claim 1, wherein said female brush member comprises a plurality of inwardly directed wire bristles.

4. The brush of claim 1, wherein said male brush member comprises a twisted wire stem having outwardly directed wire bristles retained between the twists of said stem, said outwardly directed wire bristles being configured in a substantially cylindrical shape.

5. The brush of claim 1, wherein said female brush member and said male brush member are coaxially mounted along said longitudinal axis of said handle.

6. The brush of claim 1, including a female brush holder engageable with said female brush.

7. A combination brush comprising;

a hollow, generally cylindrical, one-piece housing having a longitudinal axis and a pair of open end portions, said housing having a grippable, external surface, an internal surface, and an internal transverse web disposed substantially perpendicular to said longitudinal axis between said open end portions;

a male brush member secured to and extending outwardly from said transverse web in one of said open end portions of said housing;

a first female brush member, and a second female brush member being of a larger size than said first female brush member; said first female brush member being engaged within a female brush holder and wherein said first female brush member with said engaged female brush holder is engageable with said internal surface; said second female brush member being engageable directly with said internal surface; wherein said housing is universally sized and constructed and arranged for carrying either of said first female brush member with said engaged holder or said second female brush member therein.

8. The combination brush of claim 7, wherein said internal surface of said housing comprises an annular shoulder.

9. The combination of claim 7, wherein said transverse web includes a boss disposed perpendicularly thereto, said boss having a closed end in said open end portion carrying either one of said first and second female brush members and an open end in said open end portion carrying said male brush member.

10. The combination brush of claim 9, wherein said first and second female brush members are each formed as an annulus having an opening through which said boss extends.

11. The combination brush of claim 7, wherein said female brush holder is a ring-like, stepped member having a predominant collar and an inwardly directed flange.

12. The combination brush of claim 11, wherein rearward axial movement of either of said female brush members is prevented by either of said annular shoulder or said flange.

13. A combination brush comprising;

a hollow, generally cylindrical, one-piece housing having a longitudinal axis and a pair of open end portions, said housing having a grippable external surface, an internal surface, and an internal transverse web disposed substantially perpendicular to said longitudinal axis between said open end portions;

a male brush member secured to and extending outwardly from said transverse web in one of said open end portions of said housing;

a first female brush member, and a second female brush member being of a larger size than said first female brush member; said first female brush member being engaged within a female brush holder and wherein said first female brush member with said engaged female brush holder is engageable with said internal surface; said second female brush member being engageable directly with said internal surface; wherein said housing is universally sized and constructed and arranged for carrying either of said first female brush member with said engaged holder or said second female brush member therein, and further wherein said female brush holder is a ring-like, externally stepped member comprising a collar having a first outer diameter and an inwardly directed flange, said flange including an outer surface defining a crown having a second outer diameter smaller than said first outer diameter.

14. The combination brush of claim 13, wherein said internal surface of said housing comprises an annular shoulder.

15. The combination brush of claim 14, wherein rearward axial movement of either of said female brush members is prevented by either of said annular shoulder or said flange.

16. The combination of claim 13, wherein said transverse web includes a boss disposed perpendicularly thereto, said boss having a closed end in said open end portion carrying either one of said first and second female brush members and an open end in said open end portion carrying said male brush member.

17. The combination brush of claim 16, each of wherein said female brush members is formed as an annulus having an opening through which said boss extends.

* * * * *

UNITED STATES PATENT AND TRADEMARK OFFICE

CERTIFICATE OF CORRECTION

PATENT NO. : 5,566,416

DATED : October 22, 1996

INVENTOR(S) : Jamie L. Karls

It is certified that error appears in the above-indentified patent and that said Letters Patent is hereby corrected as shown below:

CLAIM 16, Col. 6, Line 46, delete "each of wherein" and substitute therefor ---wherein each of---.

Signed and Sealed this

Seventh Day of January, 1997

*Attest:*

Bruce Lehman

BRUCE LEHMAN

*Attesting Officer*

*Commissioner of Patents and Trademarks*